US010700479B1

(12) United States Patent
Smith et al.

(10) Patent No.: US 10,700,479 B1
(45) Date of Patent: Jun. 30, 2020

(54) CABLE ADAPTER PANEL RETENTION CLIP

(71) Applicants: Paul Wesley Smith, Santa Barbara, CA (US); Ajay Rajgadkar, Santa Barbara, CA (US); Ryan John Schmidt, Santa Barbara, CA (US)

(72) Inventors: Paul Wesley Smith, Santa Barbara, CA (US); Ajay Rajgadkar, Santa Barbara, CA (US); Ryan John Schmidt, Santa Barbara, CA (US)

( * ) Notice: Subject to any disclaimer, the term of this patent is extended or adjusted under 35 U.S.C. 154(b) by 0 days.

(21) Appl. No.: 16/399,934

(22) Filed: Apr. 30, 2019

(51) Int. Cl.
*H01R 13/73* (2006.01)
*H01R 13/74* (2006.01)

(52) U.S. Cl.
CPC ..... *H01R 13/745* (2013.01)

(58) Field of Classification Search
CPC ..... H01R 13/74; H01R 13/743; H01R 33/00; H01R 13/5202; G02B 6/3897; G02B 6/3825; G02B 6/3887
USPC .... 439/544, 552, 556, 557, 559; 385/53, 56, 385/81
See application file for complete search history.

(56) References Cited

U.S. PATENT DOCUMENTS 5,317,663 A * 5/1994 Beard ..... G02B 6/3825 385/70
5,359,688 A * 10/1994 Underwood ..... G02B 6/3825 385/53
5,418,875 A 5/1995 Nakano et al.
6,325,335 B1 * 12/2001 Harvey ..... G02B 6/3816 248/27.1
6,363,199 B1 * 3/2002 Carberry ..... G02B 6/3807 385/134
6,431,762 B1 8/2002 Taira et al.
6,780,029 B1 * 8/2004 Gretz ..... H02G 3/06 174/661
7,029,322 B2 4/2006 Ernst et al.
7,214,890 B2 * 5/2007 Kiely ..... H02G 3/0683 174/659
7,264,401 B2 9/2007 Johnson
7,296,935 B1 11/2007 Childers et al.
7,384,200 B2 * 6/2008 Nakagawa ..... G02B 6/3825 248/27.1

(Continued)

FOREIGN PATENT DOCUMENTS

CN 107329210 A 11/2017
JP 3111711 U 7/2005

(Continued)

*Primary Examiner* — Thanh Tam T Le
(74) *Attorney, Agent, or Firm* — Barcelo, Harrison & Walker, LLP; Joshua C. Harrison, Esq.

(57) ABSTRACT

A clip for retaining a connection adapter within a hole in a cable connection panel is disclosed. The clip includes left and right frames for engaging left and right facets of the body of the connection adapter, and a back span adjoining the left and right frames together. The clip also includes left and right wings that adjoin and angle externally away from the left and right frames, respectively. Each wing comprises a distal tab that angles back towards its respective frame and that is configured to protrude between an internal edge of the hole and a facet of the adapter body. Each wing further comprises a distal tab that angles externally away from its respective frame generally like the wing itself.

18 Claims, 9 Drawing Sheets

(56) References Cited

U.S. PATENT DOCUMENTS

| | | | | |
|---|---|---|---|---|
| 8,192,091 | B2 * | 6/2012 | Hsu | G02B 6/3825 385/147 |
| 8,317,409 | B2 * | 11/2012 | Li | G02B 6/3821 385/53 |
| 9,052,472 | B2 | 6/2015 | Lambourn et al. | |
| 9,229,177 | B1 | 1/2016 | Sato | |
| 9,285,548 | B2 | 3/2016 | Lin | |
| 9,297,962 | B2 * | 3/2016 | Lee | G02B 6/3825 |
| 9,383,523 | B2 * | 7/2016 | Liu | G02B 6/3897 |
| 9,470,849 | B2 * | 10/2016 | Wong | G02B 6/3825 |
| 9,547,134 | B2 | 1/2017 | Liu | |
| 10,073,225 | B2 * | 9/2018 | Weiland | H01R 13/745 |
| 2005/0058402 | A1 | 3/2005 | Ernst et al. | |
| 2007/0165984 | A1 | 7/2007 | Nakagawa | |
| 2014/0133807 | A1 | 5/2014 | Katoh | |
| 2015/0234128 | A1 | 8/2015 | Wong | |

FOREIGN PATENT DOCUMENTS

| | | | |
|---|---|---|---|
| JP | 2007187891 | A | 7/2007 |
| JP | 3153362 | U | 9/2009 |
| JP | 2009230033 | A | 10/2009 |
| JP | 2011133611 | A | 7/2011 |
| JP | 2014095834 | A | 5/2014 |

* cited by examiner

CABLE ADAPTER PANEL RETENTION CLIP

BACKGROUND

Cable connection panels typically comprise a plate with a plurality of rectangular holes to accommodate a plurality of cable-to-cable connection adapters (e.g. fiber-optic cable-to-cable adapters). For example, the panel may be a flat aluminum plate having an intended thickness specified by the design, but which has a manufacturing variation within a specified tolerance about that intended thickness. Likewise, the size of each hole in the panel has an intended height, width, and angular geometry specified by the design, but each dimension also has a manufacturing variation from hole to hole within a corresponding specified tolerance.

The connection adapters are typically retained within the panel holes using retention clips. The retention clip needs to allow for practical installation and intentional removal, while resisting unintentional removal. For example, a push-in force required to install the adapter into the panel may be specified to be within a range that facilitates practical assembly, which range may be a performance measure for the retention clip. The retention force resisting unintended removal of the adapter from the panel may be specified to be above a desired minimum, which may also be a performance measure for the retention clip.

In many conventional cable connection panels, there are gaps and clearance between the installed connection adapters and the inner periphery of corresponding panel holes. Mechanical vibration from nearby cooling fans, etc., may excite the adapters to wobble or rattle within the panel holes, which may be undesirable because it can cause noise and debris, and may loosen the retention of the connection adapters within the holes, or progressively walk an adapter unintentionally out of a corresponding hole. The gaps and clearance between the installed connection adapters and the inner periphery of corresponding panel holes may also allow the adapters to excessively wobble. Previous retention clip designs have attempted in various ways to reduce wobbling or rattling, and even have been advertised as such, yet have not acceptably reduced the problem in many applications.

Retention clips of previous designs have also provided inferior maximum retention force to resist undesired or unintentional removal. In certain previous designs, clip members that were intended to engage with the edges of the hole in the panel (through which the connection adapter is coupled) were unable to resist bending or splaying when resisting a specified removal force. Such potential bending or splaying failure of the retention clip would render the maximum retention force of the clip undesirably low in many applications.

Hence, there is a longstanding unmet need in the art for an improved retention clip for coupling an adapter within a cable connection panel. For example, there is a longstanding need in the art for an improved retention clip that can resist splaying and thereby improve maximum retention force, reduce wobbling or rattling, facilitate installation, or better accommodate or widen the acceptable variation in panel thickness or panel hole dimensions.

DESCRIPTION OF EXAMPLE EMBODIMENTS

Figure 1:
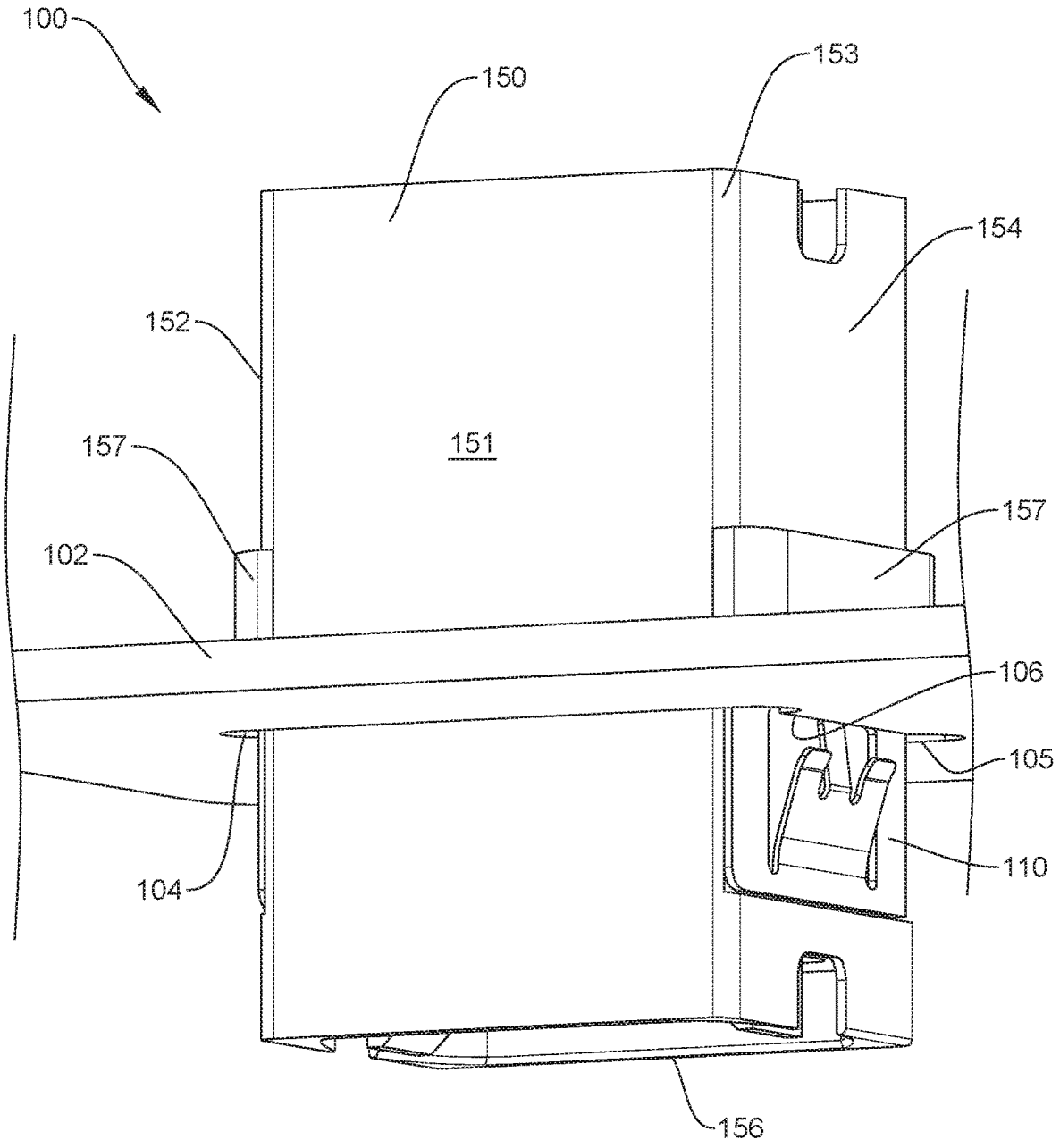
FIG. 1 depicts an assembled perspective view of a cable connection panel assembly according to an embodiment of the present invention, with a novel retention clip being coupled to a conventional thin plate through a wide hole.

FIG. 1 depicts an assembled perspective view of a cable connection panel assembly 100 according to an example embodiment of the present invention, with a novel retention clip 110 that couples a cable connection adapter 151 to a conventional plate 102. The conventional plate 102 may be part of a panel of an electronics enclosure or cabinet, for example. In the example assembly 100, the cable connection adapter 151 may be disposed downward within a hole 105 until an insertion stop 157 of the connection adapter 151 registers against a surface of the plate 102. The connection adapter 151 includes an adapter body 153 that may have a front facet 150, a right facet 152, a left facet 154, and a rear facet 156. The plate 102 has right and left internal edges 104, 106 within the hole 105, the right and left internal edges 104, 106 being adjacent to the right and left facets 152, 154 of the adapter body 153, respectively.

The design of the retention clip 110 preferably compensates for normal manufacturing tolerances in the intended thickness of the plate 102 and the intended dimensions of the hole 105. Moreover, there may be a range of intentional hole sizes and intended plate thicknesses that the clip 110 must accommodate, to be useful in more than one application or for more than one customer or product. For example, the plate 102 may be intentionally designed to have a hole 105 that is wide (e.g. 13.5 mm×10 mm opening) or tight (e.g. 13 mm×9.5 mm opening). The plate 102 may also be intentionally designed to be thick (e.g. have a thickness of 1.7 mm) or thin (e.g. have a thickness of 1.2 mm). Optionally, the dimensions of the clip 110 are selected to enable coupling of the adapter 151 to the plate 102 at the extremes of the expected range in plate thicknesses and hole dimensions, so that it can also perform coupling for hole sizes and plate thicknesses within the ranges. To illustrate how this may be done, FIG. 1 depicts the clip 110 being used to couple the adapter 151 to a thin plate 102 with a wide hole 105.

Figure 2:
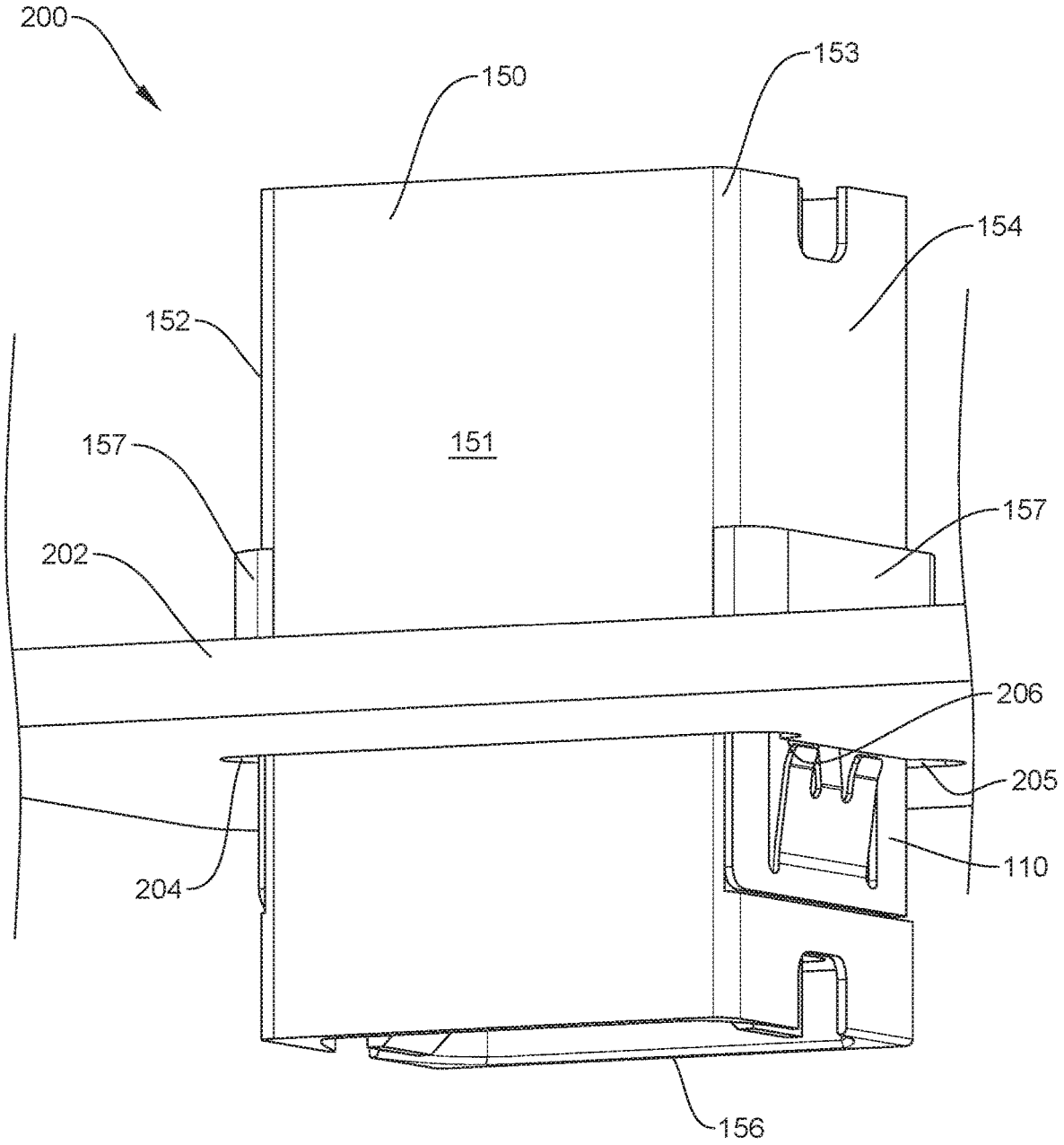
FIG. 2 depicts an assembled perspective view of a cable connection panel assembly with the novel retention clip being coupled to a conventional thick plate through a tight hole.

By contrast, FIG. 2 depicts an assembled perspective view of a cable connection panel assembly 200 with the novel clip 110 coupling the cable connection adapter 151 to a conventional thick plate 202, within a tight hole 205. The plate 202 has right and left internal edges 204, 206 within the hole 205, the right and left internal edges 204, 206 being adjacent to the right and left facets 152, 154 of the adapter body 151, respectively. Although only one hole 205 is shown in FIG. 2, with the plate 202 being coupled to only one cable connection adapter 151 with one novel clip 110, the plate 202 may optionally include a plurality of holes 205 through which a plurality of cable connection adapters 151 are coupled, by use of a plurality of clips 110, respectively.

Figure 3A:
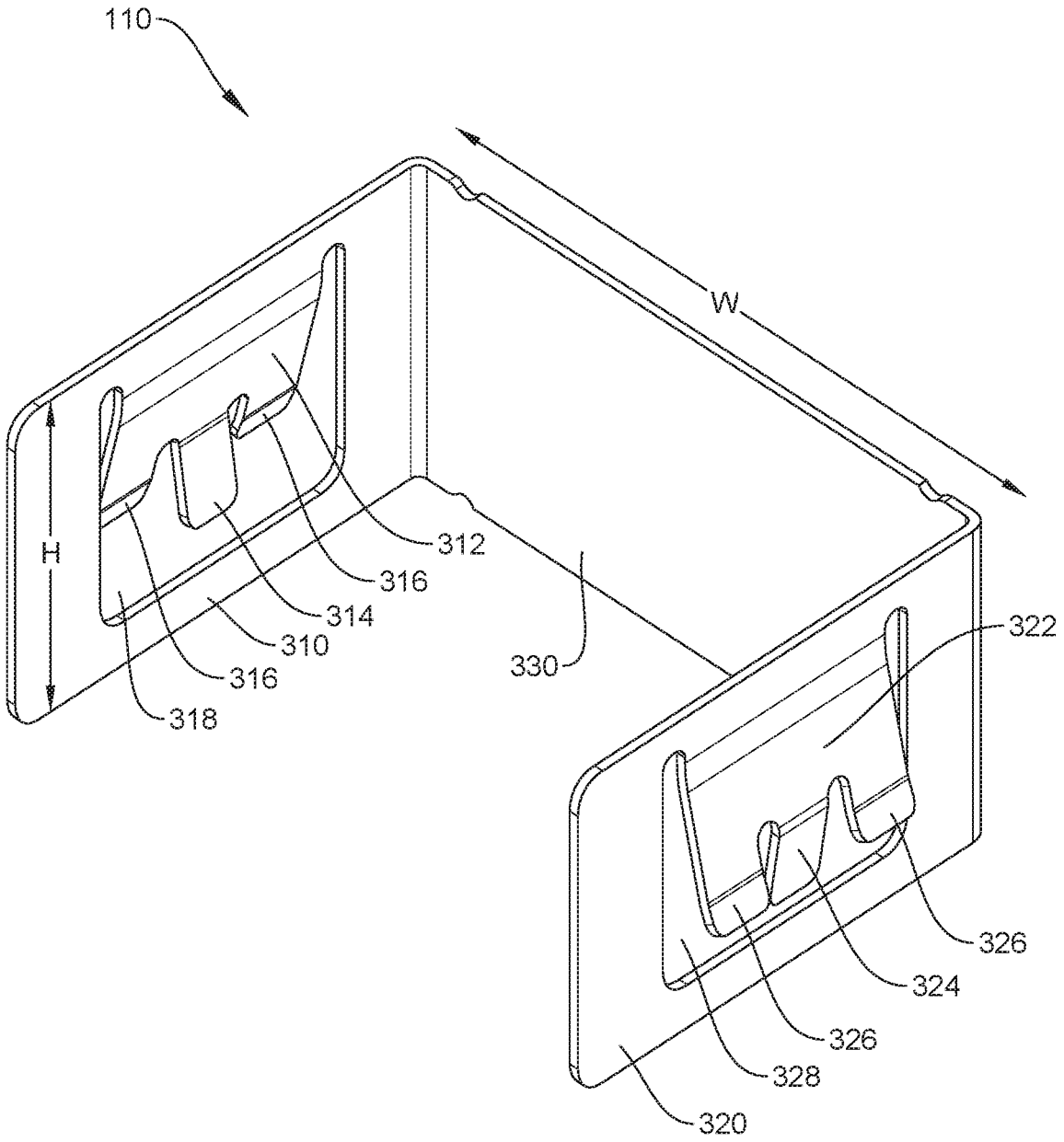
FIG. 3A depicts a perspective view of a cable connection panel assembly retention clip according to an embodiment of the present invention.
Figure 3B:
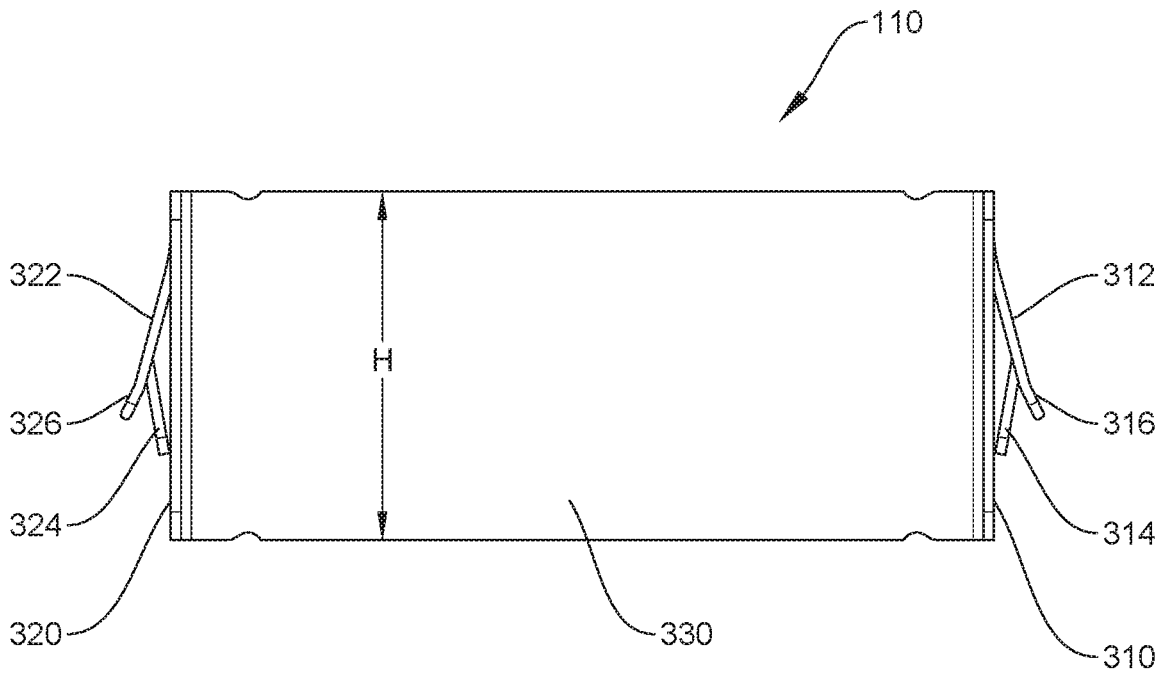
FIG. 3B is a rear view of the clip of FIG. 3A.
Figure 3C:
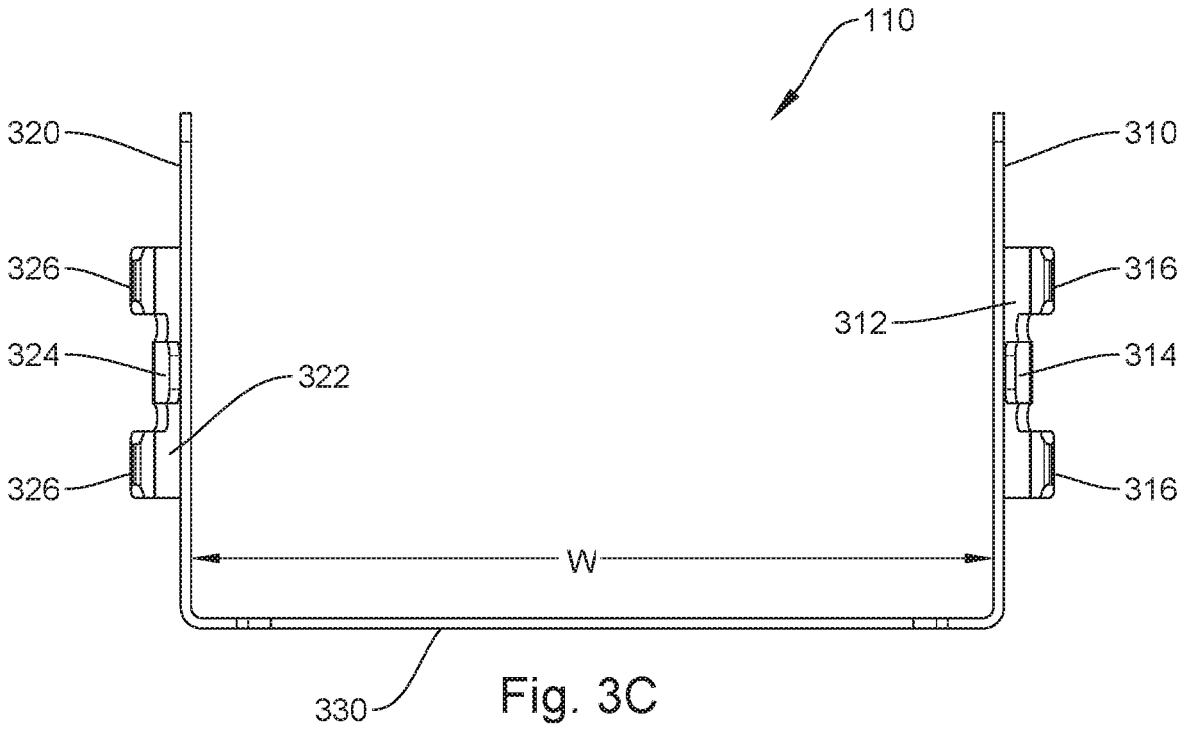
FIG. 3C is a plan view of the clip of FIG. 3A.
Figure 3D:
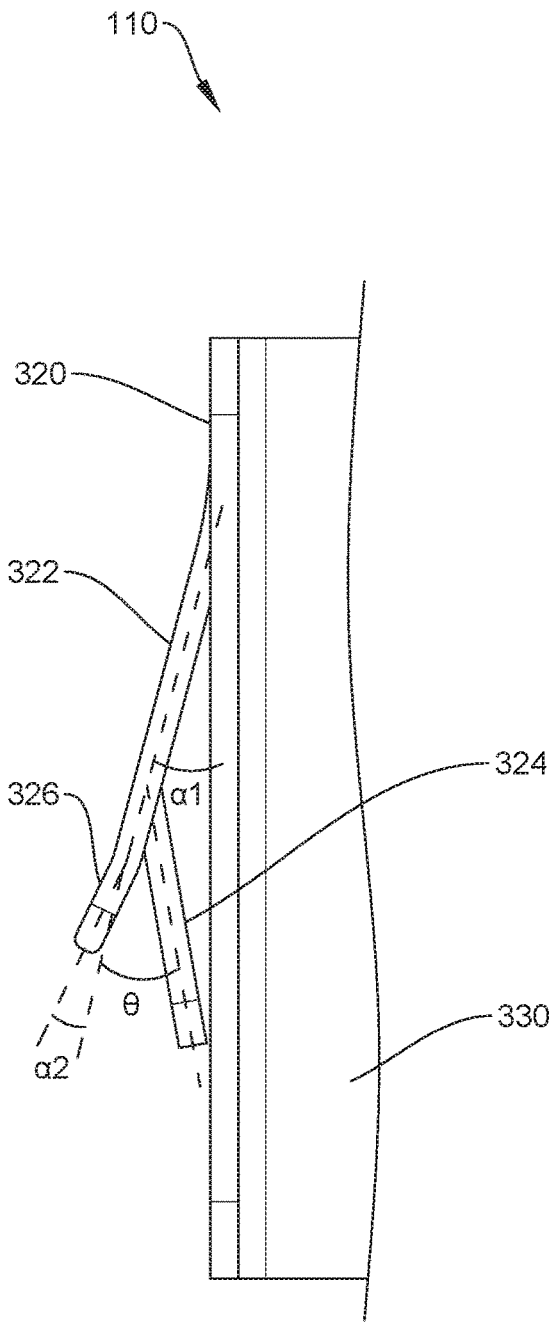
FIG. 3D is an expanded view of a portion of FIG. 3B.
Figure 3E:
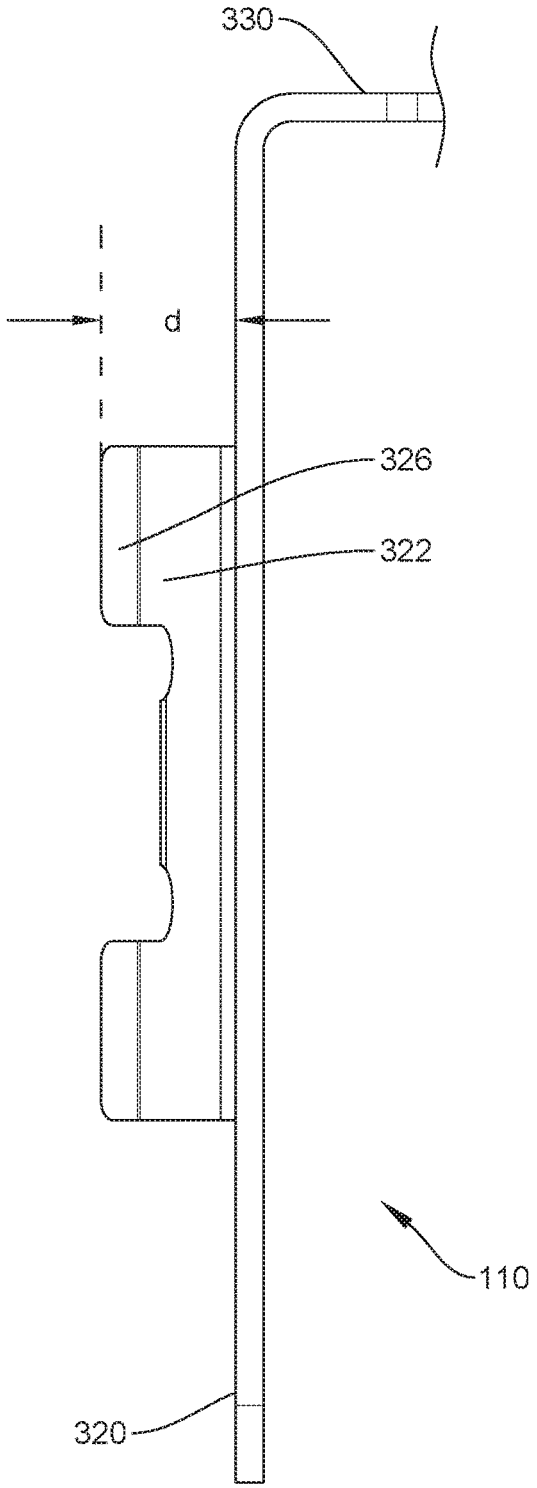
FIG. 3E is a portion of an underside view of the clip of FIG. 3A.
Figure 3F:
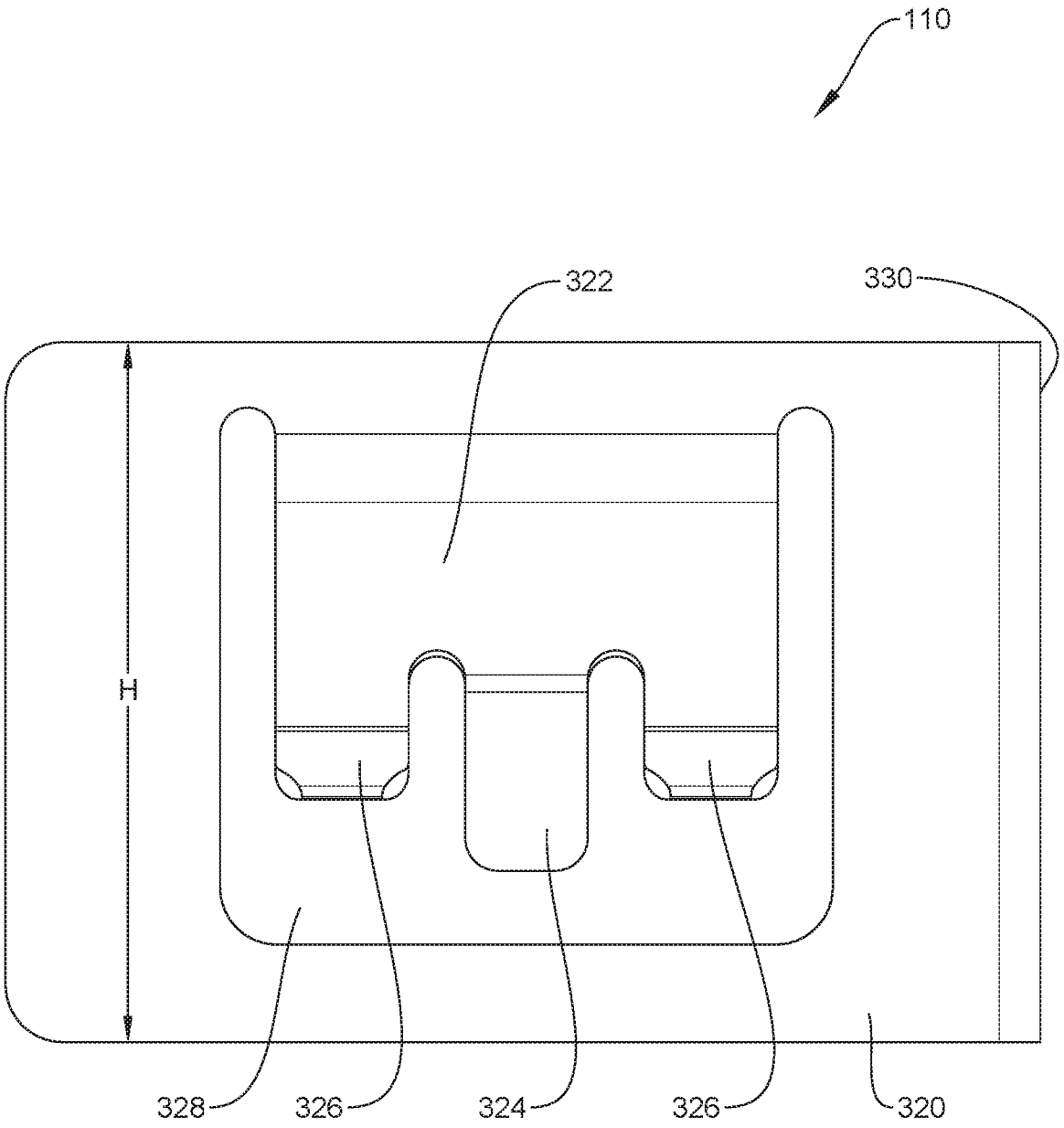
FIG. 3F is a side view of the clip of FIG. 3A.

FIG. 3A depicts a perspective view of a retention clip 110 according to an example embodiment of the present invention. FIG. 3B is a rear view of the clip 110. FIG. 3C is a plan view of the clip 110. FIG. 3D is an expanded view of a portion of FIG. 3B. FIG. 3E is a portion of an underside view of the clip 110. FIG. 3F is a side view of the clip 110. Now referring additionally to FIGS. 3A-3F, the example retention clip 110 includes a left frame 310 that is configured to contact the left facet 154 of the body 153 of the connection adapter 151, and a right frame 320 that is configured to contact the right facet 152 of the body 153 of the connection adapter 151. The clip 110 may also include a back span 330 disposed between and adjoining the left and right frames 310, 320 together. In certain embodiments, the back span may have a maximum width W that is approximately equal to a distance between the left and right frames 310, 320, and a maximum height H measured in a direction orthogonal to W, as shown.

In the example embodiment of FIGS. 3A-3F, the left frame 310 includes a left wing 312 that adjoins and angles externally away from the left frame 310, and therefore also away from the left facet 154 of the body 153 of the connection adapter 151. The left frame 310 optionally includes a left opening 318 that is preferably configured to engage with the body 153 of the connection adapter 151 to desirably limit relative motion there between or improve maximum retention force.

In this example embodiment, the left wing 312 comprises a first distal tab 314 that angles back towards the left frame 310 and therefore also back towards the left facet 154 of the body 153 of the connection adapter 151. In certain embodiments, the structure of the first distal tab 314 may advantageously increase the maximum retention force provided by the clip 110 before failure. The first distal tab 314 preferably may be configured to protrude between and possibly contact the left facet 154 of the body 153 of the adapter 151 and the left internal edge 106 of the hole 105 in the plate 102. In certain embodiments, the angle and structure of the first distal tab 314 may advantageously prevent splaying of the left wing 312 to resist undesired or unintentional removal, thereby substantially and desirably increasing the maximum retention force provided by the clip 110. Moreover, the lateral outcropping and design of the left wing 312 helps to reduce wobbling or rattling of the connection adapter 151 relative to the plate 102, or better accommodate or widen the acceptable variation in plate thickness or the dimension of the hole 105.

In this example embodiment, the left wing 312 further comprises at least one second distal tab 316 that angles externally away from the left frame 310, and therefore also away from the left facet 154 of the body 153 of the connection adapter 151. The at least one second distal tab 316 preferably may be configured to protrude towards the plate 102 of the panel 100 adjacent the left internal edge 106 of the hole 105. Optionally, the left wing 312 may include two second distal tabs 316, with the first distal tab 314 being disposed between the two second distal tabs 316. In certain applications, the structural coupling of the distal tabs 314 and 316, which results by them all being limited partial extensions of the single wing 312, may advantageously help the first distal tab 314 to prevent or resist splaying of the left wing 312 from a removal force acting on it or on the second distal tab 316.

Likewise, the right frame 320 preferably includes a right wing 322 that adjoins and angles externally away from the right frame 320, and therefore also away from the right facet 152 of the body 153 of the connection adapter 151. The right frame 320 optionally includes a right opening 328 that is preferably configured to engage with the body 153 of the connection adapter 151 to reduce relative motion there between. In certain embodiments, the right wing 322 angles externally away from the right frame 320 by a wing angle $\alpha 1$ that is preferably in the range of 0.04*W/H to 0.24*W/H radians relative to a plane defined by the right frame 320. In certain embodiments, the left wing 312 preferably angles away from the left frame 310 by a symmetrically similar angle. In certain embodiments, the right wing 322 angles externally away from the right facet 152 also by the angle $\alpha 1$, which in such embodiments preferably may be in the range of 5 degrees to 25 degrees relative to the right facet 152. In certain embodiments, the structure and angles of the right wing 322 may advantageously reduce wobbling or rattling of the connection adapter 151 relative to the plate 102, or better accommodate or widen the acceptable variation in plate thickness or the dimension of the hole 105.

In this example embodiment, the right wing 322 comprises a third distal tab 324 that angles back towards the right frame 320 and therefore also back towards the right facet 152 of the body 153 of the connection adapter 151. The third distal tab 324 preferably may be configured to protrude between and possibly contact the right facet 152 of the body 153 of the adapter 151 and the right internal edge 104 of the hole 105 in the plate 102. The third distal tab 324 angles back towards the right frame 320 or the right facet 152 by a tab angle $\theta$ that preferably may be in the range 10 degrees to 40 degrees relative to the right wing 322. Alternatively, in certain embodiments the tab angle $\theta$ preferably may be in the range $-0.75*\alpha 1$ to $-1.75*\alpha 1$, relative to the right wing 322. In this context, the negative sense of the angle $\theta$ indicates that it is back towards the right frame 320 or the right facet 152, as shown in FIG. 3D, while the positive sense of the angle $\alpha 1$ indicates that it is away from the right frame 320 or the right facet 152, also as shown in FIG. 3D. In certain embodiments, the structure and angle of the third distal tab 324 may advantageously prevent splaying of the right wing 322 to resist undesired or unintentional removal, thereby substantially and desirably increasing the maximum retention force provided by the clip 110.

In this example embodiment, the right wing 322 further comprises at least one fourth distal tab 326 that angles externally away from the right frame 320, and therefore also away from the right facet 152 of the body 153 of the connection adapter 151. The at least one fourth distal tab 326 preferably may be configured to protrude towards the plate 102 of the panel 100 adjacent the right internal edge 104 of the hole 105. Optionally, the right wing 322 may include two fourth distal tabs 326, with the third distal tab 324 being disposed between the two fourth distal tabs 326. In certain applications, the structural coupling of the distal tabs 324 and 326, which results by them all being limited partial extensions of the single wing 322, may advantageously help the third distal tab 324 to prevent or resist splaying of the right wing 322 from a removal force acting on it or on the fourth distal tab 326.

The at least one fourth distal tab 326 may angle externally away from the right frame 320 by an angle $\alpha 2$ that in certain embodiments may be substantially the same as the wing angle $\alpha 1$, relative to the plane defined by the right frame 320. However, in other embodiments, $\alpha 2$ may differ from $\alpha 1$ as shown in FIG. 3D (e.g. $\alpha 2$ may be between 10 degrees less or 20 degrees greater than $\alpha 1$ in certain embodiments). The length of the right wing 322 (including the fourth distal tab 326) and the angles α1 and α2 may be chosen so that the right wing 322 (including the fourth distal tab 326) angles externally away from the right frame 320 by a maximum lateral outcropping distance d, as shown in FIG. 3E, that in certain embodiments preferably may be in the range of 0.25 mm to 1.5 mm. In certain embodiments, the left wing 312 preferably angles away from the left frame 310 symmetrically similarly, which may improve self-centering of the connection adapter 151 within the hole 105 after assembly. In certain embodiments, the distal tab angles or range of lateral outcropping distance d may advantageously reduce wobbling or rattling of the connection adapter 151 relative to the plate 102, or better accommodate or widen the acceptable variation in plate thickness or the dimension of the hole 105.

Figure 4A:
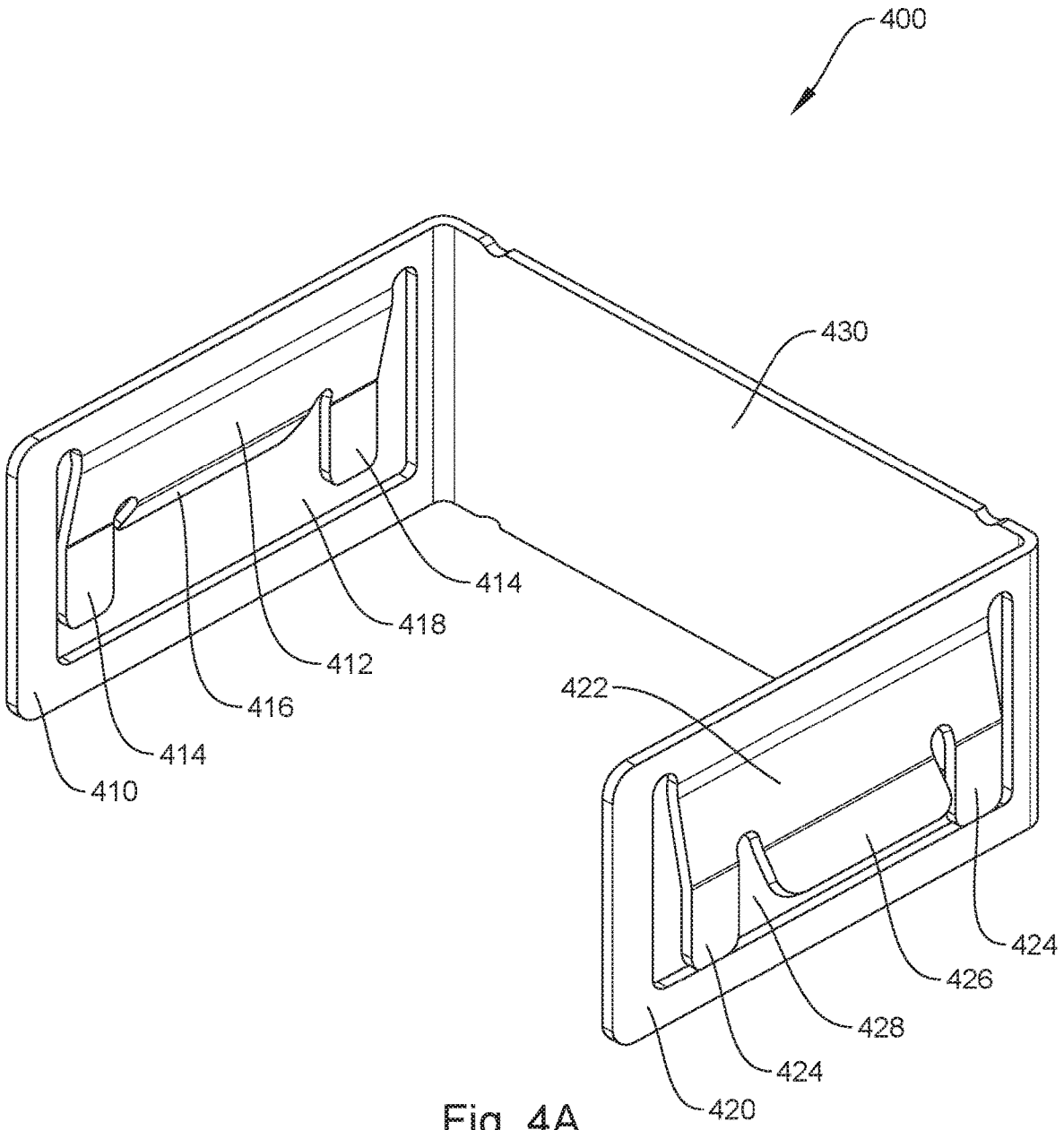
FIG. 4A depicts a perspective view of cable connection panel assembly retention clip according to another embodiment of the present invention.
Figure 4B:
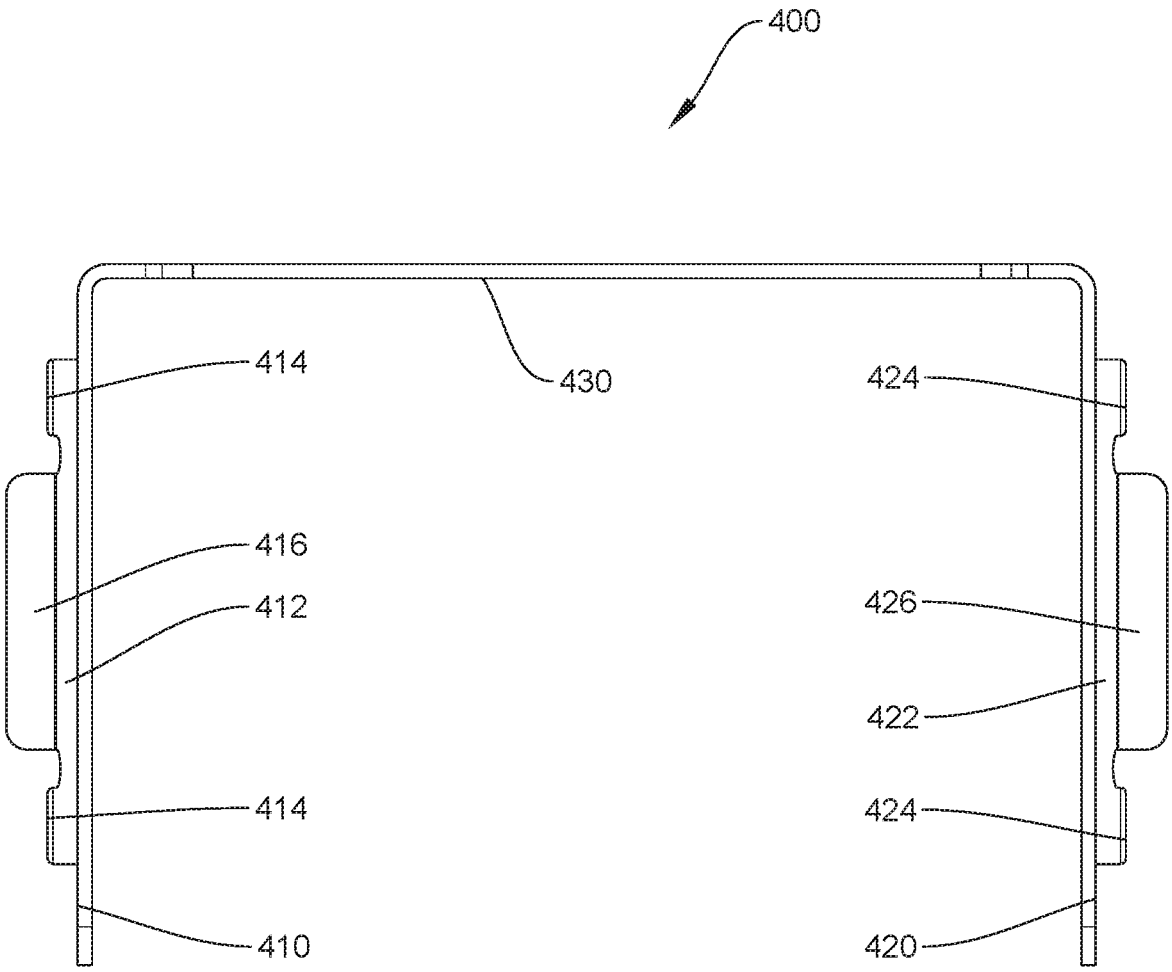
FIG. 4B is a plan view of the clip of FIG. 4A.
Figure 4C:
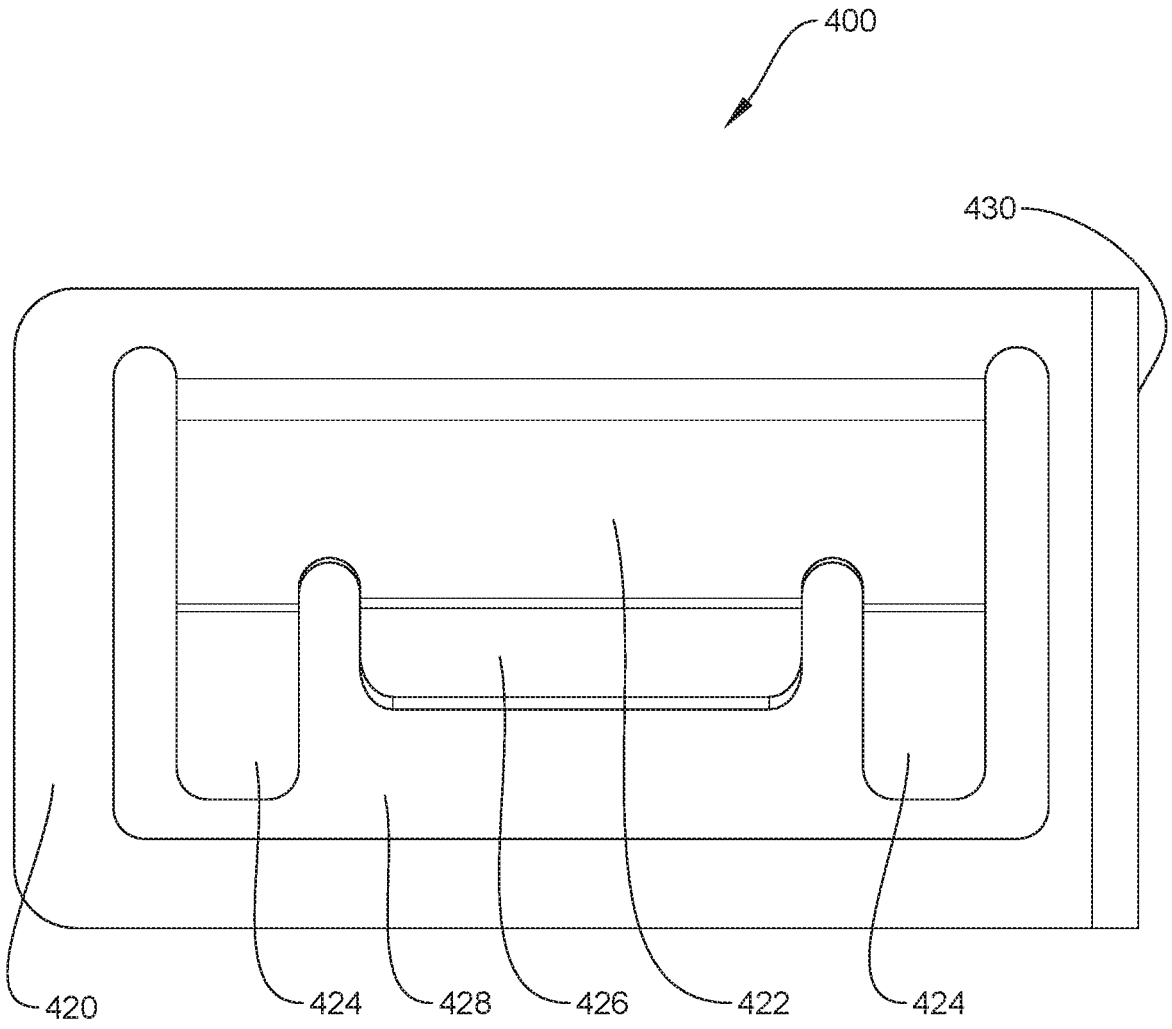
FIG. 4C is a side view of the clip of FIG. 4A.

FIG. 4A depicts a perspective view of a cable connection panel assembly retention clip 400 according to another example embodiment of the present invention. FIG. 4B is a plan view of the clip 400. FIG. 4C is a side view of the clip 400. Now referring to FIGS. 4A-4C, the example retention clip 400 includes a left frame 410, a right frame 420, and a back span 430 disposed between and adjoining the left and right frames 410, 420 together.

In the example embodiment of FIGS. 4A-4C, the left frame 410 includes a left wing 412 that adjoins and angles externally away from the left frame 410. The left frame 410 optionally includes a left opening 418. In this example embodiment, the left wing 412 comprises at least one first distal tab 414 that angles back towards the left frame 410. In certain embodiments, the structure and angle of the first distal tab 414 may advantageously make the left wing 412 more robust to resist splaying, and thereby increase the maximum retention force provided by the clip 400 before failure. In this example embodiment, the left wing 412 further comprises a second distal tab 416 that angles externally away from the left frame 410. Optionally, the left wing 412 may include two first distal tabs 414, with the second distal tab 416 being disposed between the two first distal tabs 414.

Likewise, the right frame 420 preferably includes a right wing 422 that adjoins and angles externally away from the right frame 420. The right frame 420 optionally includes a right opening 428. In this example embodiment, the right wing 422 comprises at least one third distal tab 424 that angles back towards the right frame 420. In certain embodiments, the structure and angle of the third distal tab 424 may advantageously make the right wing 422 more robust to resist splaying, and thereby increase the maximum retention force provided by the clip 400 before failure. In this example embodiment, the right wing 422 further comprises a fourth distal tab 426 that angles externally away from the right frame 420. Optionally, the right wing 422 may include two third distal tabs 424, with the fourth distal tab 426 being disposed between the two third distal tabs 424.

In the foregoing specification, the invention is described with reference to specific example embodiments, but those skilled in the art will recognize that the invention is not limited to those. It is contemplated that various features and aspects of the invention may be used individually or jointly and possibly in a different environment or application. The specification and drawings are, accordingly, to be regarded as illustrative and exemplary rather than restrictive. For example, the word "preferably," and the phrase "preferably but not necessarily," are used synonymously herein to consistently include the meaning of "not necessarily" or optionally. "Comprising," "including," and "having," are intended to be open-ended terms.

What is claimed is:

1. A cable connection panel assembly comprising:

a plate having a plate thickness and a first hole therethrough;

a first connection adapter disposed within the first hole, the first connection adapter including an adapter body having left and right facets, the plate having left and right internal edges within the first hole, the left and right internal edges being adjacent to left and right facets of the adapter body, respectively;

a first clip comprising:

a left frame in contact with the left facet of the adapter body;

a right frame in contact with the right facet of the adapter body;

a back span disposed between and adjoining the left and right frames together;

a left wing that adjoins and angles externally away from the left facet, and;

a right wing that adjoins and angles externally away from the right facet;

wherein the left wing comprises a first distal tab that angles back towards the left facet and protrudes between the left internal edge and the left facet, and the left wing further comprises a second distal tab that angles externally away from the left facet and protrudes towards the panel adjacent the left internal edge;

wherein the right wing comprises a third distal tab that angles back towards the right facet and protrudes between the right internal edge and the right facet, and the right wing further comprises a fourth distal tab that angles externally away from the right facet and protrudes towards the panel adjacent the right internal edge; and wherein the left wing of the first clip further comprises a fifth distal tab that angles externally away from the left facet and protrudes towards the panel adjacent the left internal edge, the first distal tab being disposed between the second and fifth distal tabs.

2. The cable connection panel assembly of claim 1 wherein the left frame includes a left opening, and the right frame includes a right opening, each of the left and right openings being engaged with the adapter body.

3. The cable connection panel assembly of claim 1 wherein the first distal tab contacts both the left internal edge of the first hole and the left facet of the adapter body.

4. The cable connection panel assembly of claim 3 wherein the third distal tab contacts both the right internal edge of the first hole and the right facet of the adapter body.

5. The cable connection panel assembly of claim 1 wherein the second distal tab contacts the panel adjacent the left internal edge.

6. The cable connection panel assembly of claim 5 wherein the fourth distal tab contacts the panel adjacent the right internal edge.

7. The cable connection panel assembly of claim 1 wherein the right wing of the first clip further comprises a sixth distal tab that angles externally away from the right facet and protrudes towards the panel adjacent the right internal edge, the third distal tab being disposed between the fourth and sixth distal tabs.

8. The cable connection panel assembly of claim 1 wherein the right wing angles externally away from the right facet by a wing angle α in the range of 5 degrees to 25 degrees relative to the right facet.

9. The cable connection panel assembly of claim 8 wherein the third distal tab angles back towards the right facet by a tab angle θ in the range 10 degrees to 40 degrees relative to the right wing.

10. A clip for retaining the body of a connection adapter within a hole in a cable connection panel, the hole having left and right internal edges adjacent to left and right facets of a body of the connection adapter, the clip comprising:

a left frame being configured to contact the left facet of the body of the connection adapter;

a right frame being configured to contact the right facet of the body of the connection adapter;

a back span disposed between and adjoining the left and right frames together;

a left wing that adjoins and angles externally away from the left frame, and;

a right wing that adjoins and angles externally away from the right frame;

wherein the left wing comprises a first distal tab that angles back towards the left frame and is configured to protrude between the left internal edge of the hole and the left facet of the body of the adapter, and the left wing further comprises a second distal tab that angles externally away from the left frame and is configured to protrude towards the panel adjacent the left internal edge;

wherein the right wing comprises a third distal tab that angles back towards the right frame and is configured to protrude between the right internal edge of the hole and the right facet of the body of the adapter, and the right wing further comprises a fourth distal tab that angles externally away from the right frame and is configured to protrude towards the panel adjacent the right internal edge; and wherein the left wing further comprises a fifth distal tab that angles externally away from the left frame, the first distal tab being disposed between the second and fifth distal tabs.

11. The clip of claim 10 wherein the left frame includes a left opening, and the right frame includes a right opening, each of the left and right openings being configured to engage with the body of the connection adapter.

12. The clip of claim 10 wherein the first distal tab is configured to contact both the left internal edge of the hole and the left facet of the adapter body, and the third distal tab is configured to contact both the right internal edge of the hole and the right facet of the adapter body.

13. The clip of claim 10 wherein the right wing of the first clip further comprises a sixth distal tab that angles externally away from the right frame, the third distal tab being disposed between the fourth and sixth distal tabs.

14. The clip of claim 10 wherein the back span has a maximum width W that is approximately equal to a distance between the left and right frames, and a maximum height H in a direction orthogonal to W, and the right wing angles externally away from the right frame by a wing angle α in the range of 0.04*W/H to 0.24*W/H radians relative to a plane defined by the right frame.

15. The clip of claim 14 wherein the fourth distal tab angles externally away from the right frame by substantially the same wing angle α relative to the plane defined by the right frame.

16. The clip of claim 14 wherein the third distal tab angles back towards the right frame by a tab angle θ in the range −0.75*α to −1.75*α, relative to the right wing.

17. The clip of claim 10 wherein the right wing angles externally away from the right frame by a maximum lateral outcropping distance d in the range of 0.25 mm to 1.5 mm.

18. The clip of claim 10 wherein the third distal tab angles back towards the right frame sufficiently for a distal end of the third distal tab to laterally extend back to a plane defined by the right frame.

* * * * *